United States Patent [19]

Derby

[11] Patent Number: 4,691,371

[45] Date of Patent: Sep. 1, 1987

[54] RECEPTACLE HAVING IMPROVED DISCHARGE SPOUT

[75] Inventor: Norwin C. Derby, Dallas, Tex.

[73] Assignee: Super Sack Manufacturing Corporation, Dallas, Tex.

[21] Appl. No.: 813,407

[22] Filed: Dec. 26, 1985

[51] Int. Cl.[4] ..... B65D 33/16

[52] U.S. Cl. ..... 383/62; 222/530; 383/67; 383/906

[58] Field of Search ..... 383/62, 67, 906, 904, 383/48, 50; 222/530, 538

[56] References Cited

U.S. PATENT DOCUMENTS

| | | | |
|---|---|---|---|
| 2,685,385 | 8/1954 | Kuss | 222/530 |
| 2,894,661 | 7/1959 | Simkins | 222/530 |
| 3,212,698 | 10/1965 | Balcom | 383/67 |
| 3,217,934 | 11/1965 | Schneider et al. | 383/906 |
| 3,374,929 | 3/1968 | Silfverskiold | 383/67 |
| 3,789,897 | 2/1974 | Saito | 383/67 |
| 3,961,655 | 6/1976 | Nottrass et al. | 383/906 |
| 4,124,049 | 11/1978 | Yamaguchi | 222/530 |
| 4,221,250 | 9/1980 | Manerba | 383/906 |
| 4,222,422 | 9/1980 | Lofberg | 383/904 |
| 4,235,366 | 11/1980 | Achelpohl et al. | 383/906 |

FOREIGN PATENT DOCUMENTS

| | | | |
|---|---|---|---|
| 1058928 | 6/1959 | Fed. Rep. of Germany | 383/50 |
| 997431 | 7/1965 | United Kingdom | 383/48 |

*Primary Examiner*—Stephen P. Garbe
*Attorney, Agent, or Firm*—Michael A. O'Neil

[57] ABSTRACT

A receptacle (10) is provided including an enclosure (20) having a bottom wall (42). The bottom wall (42) is provided with an opening (48) through which a discharge spout (50) extends. The discharge spout (50) can be drawn across the opening (48) and inserted in a pocket (64) mounted on the bottom wall (42) to prevent the contents of the receptacle (10) from discharging through the opening (48). A strap (56) is secured to the lower end of the discharge spout (50) to facilitate removal of the spout from the pocket (64).

10 Claims, 8 Drawing Figures

FIG. 1
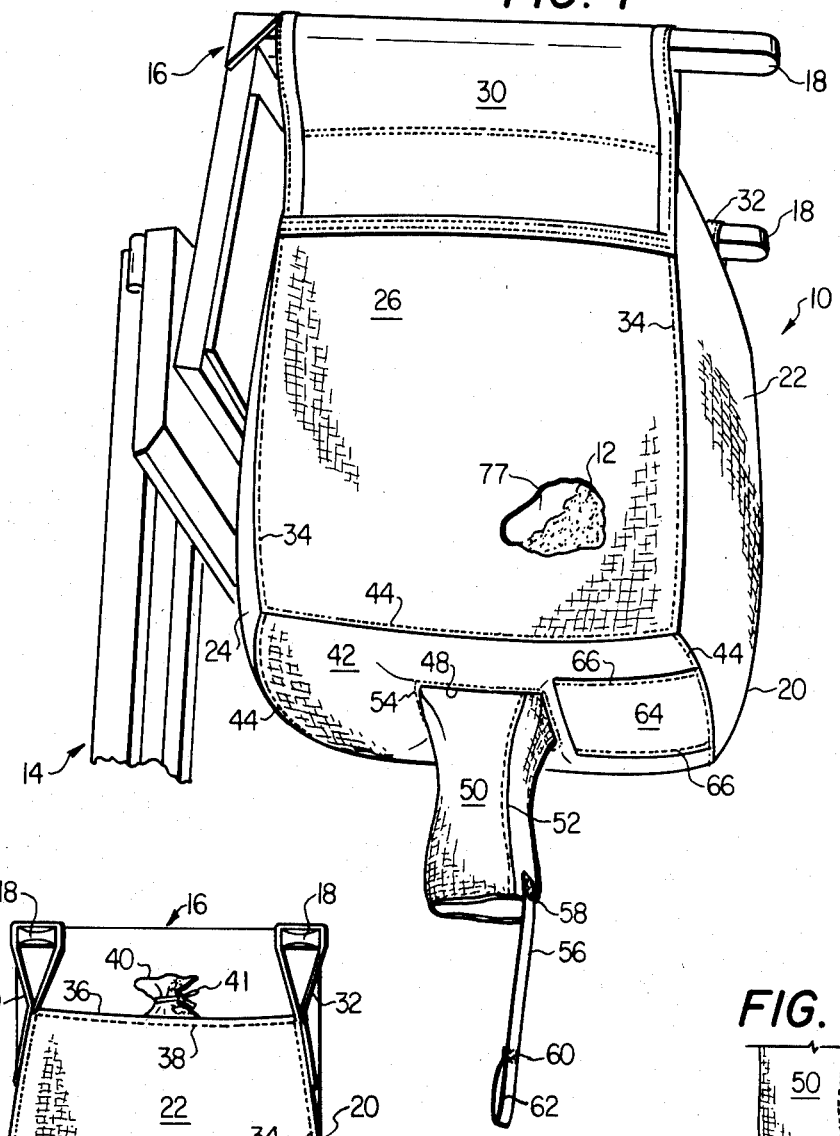
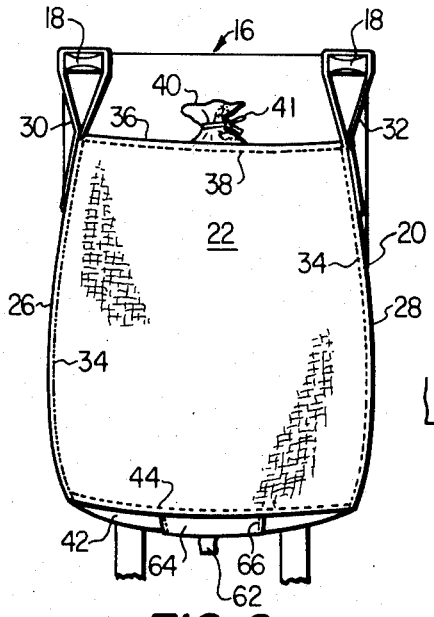
FIG. 2
FIG. 3
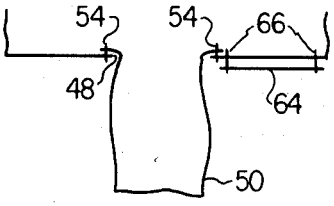
FIG. 4
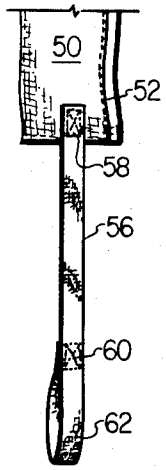

RECEPTACLE HAVING IMPROVED DISCHARGE SPOUT

TECHNICAL FIELD

This invention relates to a discharge spout used with containers for handling flowable materials, and more particularly to a receptacle wherein the discharge spout can be easily opened from a location not directly beneath the receptacle.

BACKGROUND AND SUMMARY OF THE INVENTION

Various types of receptacles have been developed for handling particulate, granular, powdered or other flowable materials, such as chemicals, minerals, fertilizers, foodstuffs, grains, agricultural products and the like. Such receptacles are typically equipped with straps or other structure allowing them to be lifted and transported by overhead cranes, fork-lifts or other transporting devices. Material carried by the receptacles is contained by an enclosure fashioned from either rigid or flexible material. More recently, receptacles having enclosures manufactured from flexible material have come into wide use in many applications due to their relatively low weight, lower resulting freight costs, reduced manufacturing costs, and improved versatility. For example, the construction of a number of flexible receptacles used in the handling of semi-bulk quantities of flowable materials is disclosed in U.S. Pat. Nos. 4,143,796, 4,194,652 and 4,457,456.

Receptacles used for handling flowable materials often include an opening in the bottom wall of the enclosure through which material can be conveniently discharged. In most cases, a flexible tubular discharge spout extends either through or from the opening in the bottom wall of the enclosure to confine and direct materials discharging from the receptacle. The opening in the bottom wall of the receptacle enclosure is sealed by tying a wire, cord, strap or the like about the flexible spout to prevent the discharge of material as the receptacle is filled and transported. The receptacle can easily be positioned above a desired location, where the the discharge spout is untied to allow the contents of the receptacle to discharge.

Discharge spouts used in the past have proven to be undesirable for a number of reasons. For example, in order to untie the spout to allow discharge of the contents of the receptacle an individual must move directly below the receptacle, thereby exposing him/herself to injury in the event the receptacle, which may weigh as much as 3,000 pounds when full, is accidentally dropped. In certain applications, individuals are exposed to the risk of contacting toxic or caustic materials carried by the receptacle as they begin discharging when the spout is untied. Individuals are also often required to approach hazardous areas in order to untie the discharge spout where, for example, the contents of receptacle are to be deposited through an opening in the underlying surface or into an underlying container holding hazardous substances.

The present invention comprises a receptacle having a discharge spout which overcomes the foregoing and other difficulties associated with previously known receptacles. The receptacle includes an enclosure having a bottom wall for supporting materials contained by the enclosure. A flexible discharge spout extends from the opening in the bottom wall. A pocket is provided on the exterior of the enclosure for securing the discharge spout against the bottom wall of the enclosure. When inserted in the pocket, the discharge spout is drawn across the opening in the bottom wall of the receptacle, thereby preventing discharge of the contents of the receptacle. The opening in the bottom wall of the enclosure is sealed prior to filling the receptacle by placing the discharge spout within the pocket. Once the receptacle is filled and moved to a desired location, the discharge spout may be pulled from the pocket by an individual positioned to the side of the receptacle with a hook or other suitable device, thereby allowing materials to discharge from the receptacle.

In one embodiment of the invention, a strap, or other length of flexible material is secured to the lower end of the discharge spout and remains at least partially exposed when the lower end of the spout is placed within the pocket on the exterior of the enclosure. The spout can be easily withdrawn from the pocket by pulling on the exposed portion of the strap.

In another embodiment of the invention, the lower end of the discharge spout is provided with a releaseable fastener for securing the spout within the pocket.

In yet another embodiment of the invention, at least a portion of the interior surface of the enclosure of the receptacle is covered by a liner. The liner passes through the discharge spout and extends some distance beyond the lower end of the spout. The portion of the liner extending from the discharge spout is sealed to prevent the discharge of materials from the receptacle. The pocket includes an opening through which the lower end of the liner may be drawn once the discharge spout is fully inserted and secured within the pocket, thereby allowing the liner to be opened before removal of the discharge spout from the pocket.

BRIEF DESCRIPTION OF THE DRAWINGS

A more complete understanding of the invention can be had by reference of the following detailed description when taken in conjunction with the accompanying drawings, wherein:

FIG. 1 is a bottom side perspective view of a receptacle incorporating a first embodiment of the invention having a discharge spout shown in its open position;

FIG. 2 is a front view of the receptacle shown in FIG. 1 wherein the discharge spout is in its closed position;

FIG. 3 is a diagramatic vertical section view through the discharge spout shown in FIG. 1;

FIG. 4 is an enlarged side view of the lower portion of the discharge spout of the embodiment shown in FIG. 1;

DETAILED DESCRIPTION

Figure 5:
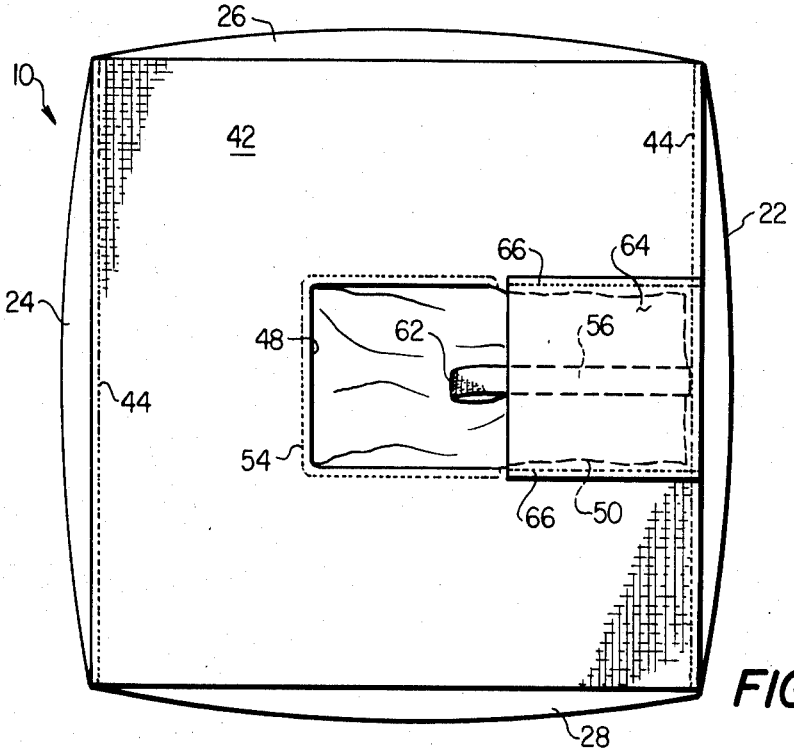
FIG. 5 is a bottom view of the embodiment shown in FIG. 1 wherein the discharge spout is in its closed position.

Referring now to FIGS. 1 and 2, there is shown a receptacle 10 containing a quantity of flowable material 12. The material 12 may comprise, for example, minerals, chemicals, fertilizers, food stuffs, agricultural products and the like. The receptacle 10 is constructed from a strong yet flexible material, such as woven polypropylene or polyethylene.

The receptacle 10 is supported by a fork-lift 14 (partially shown), which includes a fork attachment 16 having two horizontally extending fork arms 18. The fork attachment 16 is raised and lowered by the fork-lift 14 to vertically position the receptacle 10. Alternatively, if desired, the receptacle 10 can be lifted and carried by a crane or the like using an attachment having arms similar to the fork arms 18 of the fork-lift 14.

The receptacle 10 has an enclosure 20 for containing the material 12 comprising a front side wall 22, back side wall 24, left side wall 26 and right side wall 28. The side walls 22, 24, 26 and 28 are all generally rectangular; however, the left and right side walls 26 and 28 are relatively longer than the front and rear side walls 22 and 24. The left and right side walls 26 and 28 extend above the enclosure and are folded back over and secured to themselves to form a pair of lift sleeves 30 and 32, respectively. The side walls 22, 24, 26 and 28 are joined along adjacent edges thereof by lines of stitching 34. A top panel 36 is secured between the upper edges of the side walls 22, 24, 26 and 28 by lines of stitching 38. The top panel 36, includes a centrally located opening (not shown) in which a fill spout 40 is mounted. The fill spout 40 is generally tubular and is secured at its lower end about the circumference of the opening in the top panel 36. The flowable material 12 is introduced into the receptacle 10 through the fill spout 40, which may then be closed by a wire tie 41, or other suitable device. The enclosure 20 is completed by a bottom wall 42 secured about is periphery to the bottom edges of the side walls 22, 24, 26 and 28 by lines of stitching 44. Other details of the construction of the receptacle 10 are disclosed in U.S. Pat. No. 4,457,456, the disclosure of which is incorporated herein by reference.

The bottom wall 42 includes a centrally located opening 48. As is best shown in FIGS. 5, 6, 7 and 8, the opening 48 is preferably square, although other rectangular and circular configurations could be utilized. The corners of the opening 48 are rounded to minimize the possibility of tearing of the material comprising the bottom wall 42.

Referring again to FIGS. 1 and 2, a discharge spout 50 extends downwardly through the opening 48 in the bottom wall 42. The discharge spout 50 comprises a length of flexible material, such as polypropylene or polyethylene, secured in the form of a tube by a stitching line 52, or by other suitable means. As is best illustrated diagramatically in FIG. 3, the upper end of the discharge spout 50 is secured to the inner surface of the bottom wall 42 of the receptacle 10 about the perimeter of the opening 48 by a line of stitching 54, or by other suitable means.

Referring to FIGS. 1, 2 and 4, secured to the lower or distal end of the discharge spout 50 is a strap 56. The strap 56 is preferably manufactured from cloth, woven polyethylene or polypropylene, or other flexible material. The strap 56 is secured at its upper end to the discharge spout 50 by means of stitching 58, or by other suitable means. The lower end of the strap 56 is folded over upon itself and secured by stitching 60, or other fastening means, to form a loop 62. When the discharge spout 50 is in the extended position shown in FIGS. 1 and 2, the material 12 within the receptacle 10 is able to flow freely out of the opening 48 in the bottom wall 42 and through the discharge spout 50.

Referring now to FIGS. 1, 2, 3 and 4, a pocket 64, comprising a piece of flexible material such as cloth, woven polyethylene or polypropylene, or fabric, is secured to the bottom wall 42 of the receptacle 10 adjacent the opening 48 to facilitate closure of the opening 48 in preparation for filling or transport of the receptacle 10. The pocket 64 is secured to the bottom wall 42 of the receptacle 10 along its lateral edges by stitching lines 66 and along its edge adjacent the front side wall 22 by a portion of the stitching line 44.

As is shown in FIGS. 2 and 5, the discharge spout 50 can be inserted within the pocket 64 to close the opening 48. Insertion of the distal or lower end of the discharge spout 50 within the pocket 64 draws a portion of the upper end of the spout 50 across the opening 48, preventing the flow of materials through the opening 48. The discharge spout 50 extends from the opening 48 a distance roughly twice the distance across the opening 48 to allow the lower half of the spout to be inserted within the pocket 66. Accordingly, the pocket 66 is preferably located immediately adjacent the opening 48 and is sufficiently deep to accommodate the lower half of the discharge spout 50.

As shown in FIG. 5, the discharge spout 50 is preferably folded flat within the pocket 64. When the discharge spout 50 is properly inserted within the pocket 64, the strap 56 is positioned below the spout 50. The length of the strap 56 is sufficient to allow its loop 62 to extend from the pocket 64 when the discharge spout 50 is fully inserted therein. Removal of the discharge spout 50 from the pocket 66 is easily accomplished by pulling on the loop 62 of the strap 56 by means of a hook, or other suitable device. The strap 56 is secured to the side of the discharge spout 50 closest to the front side wall 22, so that the strap 56 will tend to pull both the upper and lower folds of the discharge spout 50 from the pocket 56 simultaneously.

Figure 6:
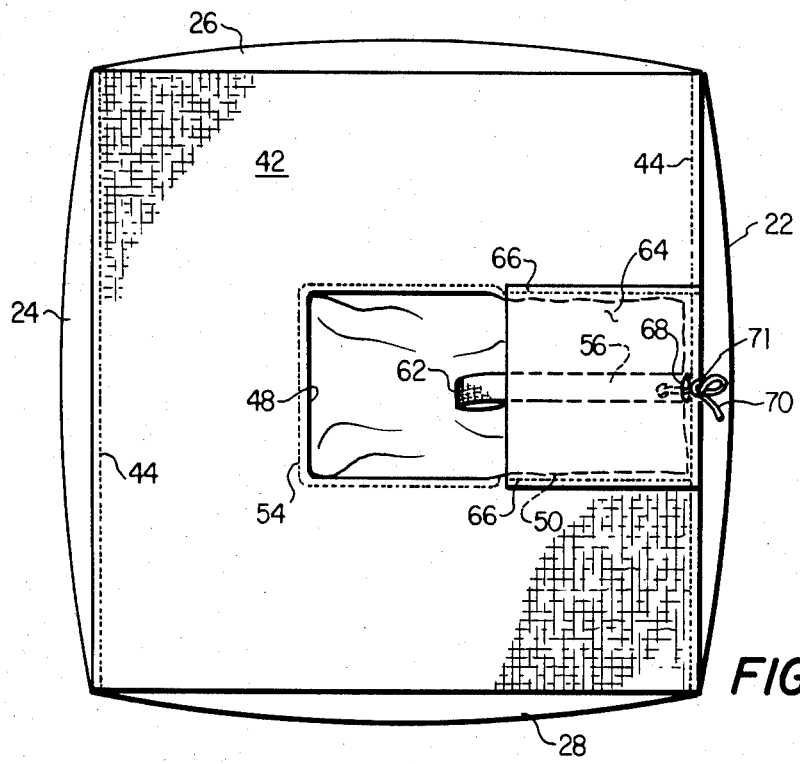
FIG. 6 is a bottom view of a receptacle incorporating a second embodiment of the invention wherein the discharge spout in its closed position.

FIG. 6 illustrates a second embodiment of the invention in which fastening means are provided for preventing removal of the discharge spout 50 from the pocket 64. The fastening means includes an aperture 68 provided through the pocket 64 adjacent the front edge of the bottom panel 42 of the receptacle 10. A tether line 70 is secured to the distal end of the discharge spout 50. The line 70 can be drawn through the aperture 68 and tied in a knot 71, as shown in FIG. 6. The diameter of the aperture 68 is only large enough to accommodate the diameter of the line 70, and will not allow passage of the line 70 back into the pocket 64 once knotted. The line 70 is used in this manner to prevent the discharge spout 50 from being pulled out of the pocket 64 prematurely, particularly when the receptacle 10 is being filled. It will be apparent that the line 70 must therefore be untied before the discharge spout 50 can be removed from the pocket 64. Alternatively, the line 70 could be of sufficient length to be trained through the aperture 68 and secured to another tether line or other structure mounted on the exterior of the receptacle 10.

Figure 7:
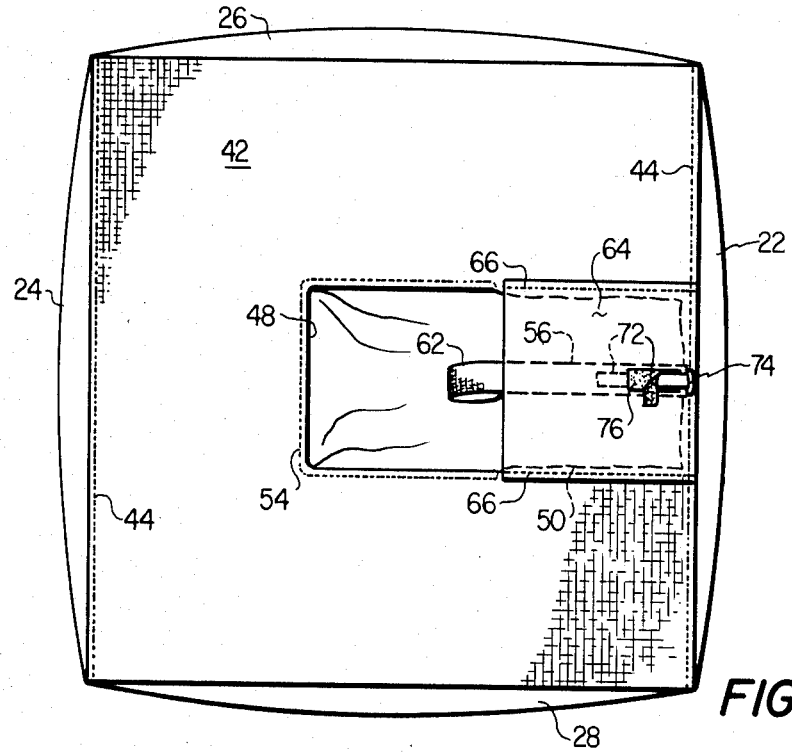
FIG. 7 is a bottom view of a receptacle incorporating a third embodiment of the invention wherein the discharge spout in its closed position.

The embodiment of FIG. 7 includes alternative fastening means for securing the discharge spout 50 within the pocket 64. A strip 72 of male Velcro TM fastening material is secured to the distal end of the discharge spout 50 adjacent the strap 56. Once the discharge spout 50 is fully inserted within the pocket 64, the strip 72 is drawn through an aperture 74 in the pocket 64 adjacent the front of the receptacle 10. A strip 76 of female Velcro TM fastening material is secured to the pocket 64 adjacent aperture 74. The strips 72 and 74 are engaged to secure the discharge spout 50 within the pocket 64, and may easily be disengaged to release the spout 50 for removal from the pocket 64.

Figure 8:
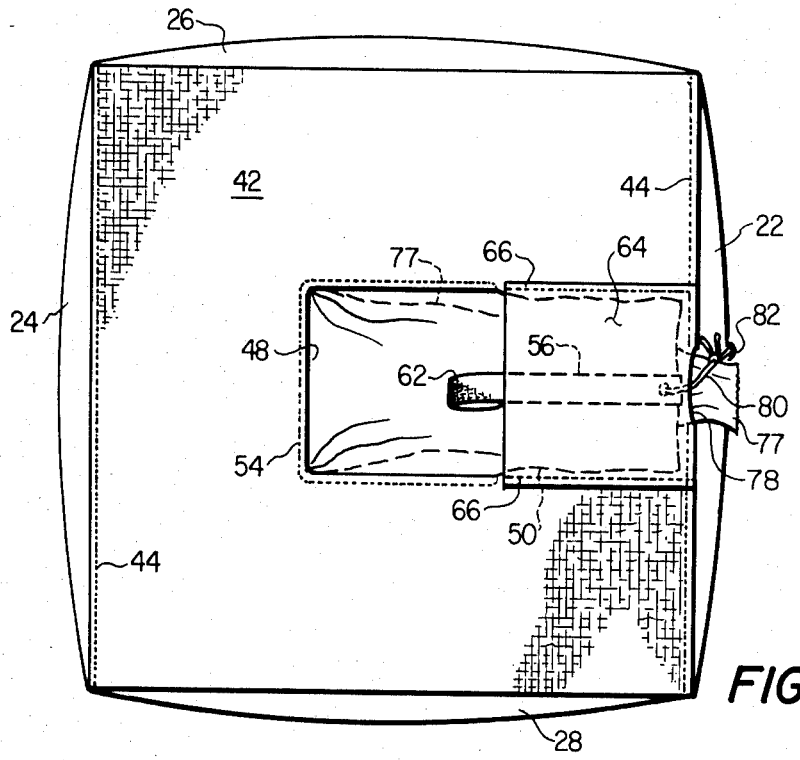
FIG. 8 is a bottom view of a receptacle incorporating a fourth embodiment of the invention wherein the discharge spout in its closed position.

FIG. 8 illustrates yet another alternative fastening means for securing the discharge spout 50 within the pocket 64. The interior of the enclosure 20 of the receptacle 10 is at least partially covered by a liner 77 (also shown in FIG. 1) manufactured from plastic or another appropriate material. The liner 77 extends through the discharge spout 50 and beyond the lower end of the spout 50, where the liner 77 is sealed, by heat treatment or other means, prior to placement of the spout 50 within the pocket to prevent the discharge of materials from the receptacle 10 during filling or transporting activities. A slit or opening 78 is provided through the pocket 64 of sufficient size to allow the exposed, sealed portion of the liner 77 to be drawn therethrough. The slit is preferably formed by an interruption of the line of stitching 44 securing the edge of the pocket 64 to the bottom wall 42 near the front side wall 22. A tether line 80 is secured to the lower end of the discharge spout 50 for fastening the spout 50 within the pocket 64. This is accomplished by drawing the tether line 80 through the slit 78 and securing the line 80 to a tether line 82 mounted on the front side wall 22 of the receptacle 10. The discharge spout 50 is freed for removal from the pocket 64 by untying the tether lines 80 and 82. Placement of the liner 77 through the slit 78 allows the sealed end of the liner 77 to be severed or opened prior to removal of the discharge spout 50 from the pocket 64, thereby allowing the discharge of materials from within the receptacle 10 once the spout 50 is pulled from the pocket 64. It will be apparent that the strips 72 and 76 of Velcro TM fastening material included in the of the embodiment shown in FIG. 7 can be utilized, if desired, in the embodiment of FIG. 8 to secure the discharge spout 50 within the pocket 64.

It will be apparent that the discharge spout 50, strap 56, pocket 64 and the various fastening means for securing the spout 50 within the pocket 64 (illustrated in FIGS. 5, 6, 7 and 8) can be incorporated with various receptacle constructions, including those disclosed in U.S. Pat. Nos. 4,143,796, 4,194,652 and 4,457,456, the disclosures of which are incorporated herein by reference.

The receptacle 10 is utilized by first fully inserting the discharge spout 50 within the pocket 64, as shown in FIGS. 5, 6, 7 and 8. The receptacle 10 may then be filled with the material 12 and carried by the lift straps 30 and 32 to a location where the material 12 is to be deposited. The loop 62 of the strap 56 connected to the distal end of the discharge spout 50 may then be grasped with a hook or other suitable tool from a point not directly beneath the receptacle 10. The strap 56 is then pulled to remove the discharge spout 50 from the pocket 64 and to initiate discharge of the material 12 from the receptacle 10.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

I claim:

1. A receptacle comprising:

an enclosure having a bottom wall for supporting materials contained by the receptacle;

a flexible discharge spout extending from an opening in the bottom wall of the enclosure;

a pocket mounted on the enclosure for securing the discharge spout across the opening in the bottom wall to prevent the contents of the receptacle from discharging through the opening the pocket having an aperature; and fastening means for securing the discharge spout within the pocket, the fastening means being secured to the discharge spout and extending through the aperture in the pocket.

2. The receptacle according to claim 1 wherein the pocket is mounted on the bottom wall adjacent the opening.

3. The receptacle according to claim 1 further comprising a spout extracting means for removing the discharge spout from the pocket to allow the contents of the receptacle to discharge through the opening and the spout.

4. The receptacle according to claim 3 wherein the spout extracting means includes a strip of flexible material secured to the discharge spout.

5. The receptable according to claim 1 further comprising a liner at least partially covering the interior surfaces of the enclosure and extending from the lower end of the discharge spout, wherein the exposed end of the liner is sealable to prevent the discharge of material from the receptacle.

6. The receptacle according to claim 5 wherein the exposed end of the liner may be drawn through the aperture in the pocket once the discharge spout is inserted in the pocket to allow the exposed end of the liner to be unsealed prior to removal of the discharge spout from the pocket.

7.A receptacle comprising:

an enclosure including a bottom wall having an opening for discharging materials contained by the receptacle;

a flexible discharge spout extending from the opening in the bottom panel through which materials are discharged from the receptacle;

a pocket for securing the discharge spout across the opening and against the bottom wall to prevent materials from discharging from the receptacle, the pocket having an aperture; and a tether line, secured to the discharge spout and extending through the aperture in the pocket, for securing the discharge spout within the pocket.

8. The receptacle according to claim 7, further comprising a strap secured to the distal end of the discharge spout for removing the spout from the pocket to allow the contents of the receptacle to discharge through the opening in the bottom wall.

9. The receptacle according to claim 7 further comprising a sealable liner having a sealable lower end extending from the discharge spout which can be drawn through the aperture in the pocket to allow the liner to be opened prior to removal of the discharge spout from the pocket.

10. A receptacle comprising:

an enclosure including a bottom wall having an opening for discharging materials contained by the receptacle;

a discharge spout including a length of flexible tubular material extending from the opening in the bottom wall through which materials are discharged from the receptacle;

a pocket mounted on the bottom wall of the enclosure adjacent the opening for securing the spout against the bottom wall and across the opening to prevent the discharge of materials from the receptacle, the pocket having an aperture;

a strap secured to the distal end of the discharge spout for removing the spout from the pocket to allow materials to discharge from the receptacle;

fastening means for securing the discharge spout within the pocket, the fastening means being secured to the discharge spout and extending through the aperture in the pocket; and a sealable liner having a sealable lower end extending from the discharge spout through the aperture in the pocket to allow the liner to be opened prior to removal of the discharge spout from the pocket.

* * * * *